US009561524B2

(12) United States Patent
Marxen et al.

(10) Patent No.: US 9,561,524 B2
(45) Date of Patent: Feb. 7, 2017

(54) METHOD FOR PROCESSING A STRUCTURED SURFACE OF AN EMBOSSING TOOL

(71) Applicant: Hueck Rheinische GmbH, Viersen (DE)

(72) Inventors: Martin Marxen, Viersen (DE); Wolfgang Stoffel, Kempen (SE)

(73) Assignee: Hueck Rheinische GmbH, Viersen (DE)

( * ) Notice: Subject to any disclaimer, the term of this patent is extended or adjusted under 35 U.S.C. 154(b) by 0 days.

(21) Appl. No.: 14/826,220

(22) Filed: Aug. 14, 2015

(65) Prior Publication Data

US 2015/0343835 A1 Dec. 3, 2015

Related U.S. Application Data

(63) Continuation of application No. 13/991,424, filed as application No. PCT/DE2012/000223 on Mar. 8, 2012, now Pat. No. 9,138,774.

(30) Foreign Application Priority Data

Mar. 10, 2011 (EP) ..... 11001986

(51) Int. Cl.
*B44B 5/02* (2006.01)
*B05D 5/00* (2006.01)
*C25F 3/16* (2006.01)

(52) U.S. Cl.
CPC ..... *B05D 5/00* (2013.01); *B44B 5/026* (2013.01); *C25F 3/16* (2013.01)

(58) Field of Classification Search
None
See application file for complete search history.

(56) References Cited

U.S. PATENT DOCUMENTS 2,854,336 A 9/1958 Gutknecht
4,213,819 A 7/1980 Werthmann
(Continued)

FOREIGN PATENT DOCUMENTS

DE 10217919 A1 11/2003
DE 10224128 A1 12/2003
(Continued)

OTHER PUBLICATIONS

Office Action of May 18, 2015, for U.S. Appl. No. 13/991,424 (see attached).

*Primary Examiner* — Allan Olsen
(74) *Attorney, Agent, or Firm* — Michael Soderman

(57) ABSTRACT

The invention relates to a method for processing a structured surface of an embossing tool, in which the entire surface is provided with a first metallic coating and said surface having, in selected regions, at least one additional metallic coating that has a differing degree of lustre. To improve the optical properties of the material boards produced using the embossing tools, particularly if reproducing a wood texture, the invention suggests that additional differing degrees of lustre should be produced in multiple selected regions on the first coating, and be produced by a combination of metallic coatings and mechanical or chemical after-treatments. Therefore, for example, a wood pore with a defined structure can be substantially better reproduced, and the optical and haptic properties of the wood composite board produced using the press plates can thus be improved.

7 Claims, 1 Drawing Sheet

(56) References Cited

U.S. PATENT DOCUMENTS

| | | | | |
|---|---|---|---|---|
| 5,596,912 | A | 1/1997 | Laurence | |
| 7,959,817 | B2 * | 6/2011 | Luetgert | E06B 3/7001 216/100 |
| 8,316,604 | B2 * | 11/2012 | Thiers | B44C 1/24 428/172 |
| 8,784,671 | B2 * | 7/2014 | Vermeulen | B44F 9/02 216/11 |
| 2002/0160680 | A1 * | 10/2002 | Laurence | B32B 27/36 442/394 |
| 2006/0144004 | A1 * | 7/2006 | Nollet | B44C 1/24 52/578 |
| 2007/0201131 | A1 * | 8/2007 | Katsura | G02B 5/0221 359/460 |
| 2009/0155593 | A1 * | 6/2009 | O'Brien | D21H 17/51 428/411.1 |
| 2010/0243138 | A1 | 9/2010 | Laurent et al. | |
| 2011/0048254 | A1 * | 3/2011 | Espe | B23K 26/0084 100/35 |
| 2011/0117325 | A1 * | 5/2011 | Segaert | B32B 3/06 428/167 |
| 2013/0025216 | A1 * | 1/2013 | Reichwein | B29C 59/026 52/105 |

FOREIGN PATENT DOCUMENTS

| | | | |
|---|---|---|---|
| EP | 2045363 | A1 | 4/2009 |
| EP | 2060658 | A2 | 5/2009 |

* cited by examiner

METHOD FOR PROCESSING A STRUCTURED SURFACE OF AN EMBOSSING TOOL

CROSS REFERENCE TO RELATED APPLICATIONS

This application is a continuation of U.S. Ser. No. 13/991,424 filed on Jun. 4, 2013, which in turn is the U.S. national stage of International Application No. PCT/DE2012/000223, filed on Mar. 8, 2012, and it claims the benefit thereof. The international application claims the benefits of European Application No. EP 11001986.6 filed on Mar. 10, 2011; all applications are incorporated by reference herein in their entirety.

BACKGROUND

The invention relates to a method for processing a surface of an embossing tool, in which at least one surface is subjected to a first treatment step over the entire area to achieve a degree of gloss and there is at least one further step in selected areas to achieve a different degree of gloss.

Generic embossing tools are required in the wood-processing industry, especially for the production of wood composite boards. The visible surfaces of the wood composite boards are embossed with the aid of the embossing tools in such a way that a desired motif, preferably a realistic reproduction of a natural surface structure, can be produced. To this end, resin films, as an example, are put on the wood composite boards, which are preferably made of particle boards, and the resin films are subsequently pressed together with the wood composite boards with pressure and heat in hydraulic heating presses. The resin film liquefies during the pressing process with pressure and heat, and polycondensation takes place. The pressing time and temperature determine the degree of cross-linkage of the resins and their surface quality. After the pressing period ends, the resin achieves the desired degree of cross-linkage and is in a solid phase. The resin surface takes on the desired, realistic surface in this process because of the surface structure of the embossing tool. Thermosetting resins, for instance melamine resins, phenolic resins or melamine/urea resins, are used as the coating material. A structured, metallic pressed sheet, preferably sheet steel, is used as the embossing tool here to structure the surface. The embossing tools are additionally provided with a coating to improve the resistance to wear and separation characteristics of the metal surface. Embossing tools that were produced with the aid of digital printing technology are used in this process as a preference, so that the decor papers that are used can likewise be produced on a correct scale and with conforming patterns according to the digital printing process.

A perfectly matching arrangement of the decor paper and the embossing structure can consequently be achieved; substantially better results than in the case of the prior art can be obtained because of that.

Embossing tools in the form of pressed sheets or endless sheets are manufactured via the corresponding processing of the surface in the prior art and, in fact, via the production of a desired surface structure. In the past, the pretreated sheet was provided with a matrix for this purpose, for instance by means of a screen-printing method, so that the sheet can then be etched. The sheet is only etched in connection with this in the areas that are not covered by the matrix. Very precise processing and especially processing with conforming patterns are required in connection with this due to the pressed-sheet size that is used, in so far as the surface structure is produced in several work steps. All of the areas that are supposed to form the raised surface structure later on are covered over and over again by the mask in connection with this, so the surface will only be etched in the areas that can be directly corroded by the etching fluid. The etched areas then form the profile valleys of the desired structure; the surfaces are cleaned and the mask is removed after the end of the respective etching process. This procedure can be repeated several times; the precision in the case of screen-printing processes causes substantial difficulties as a rule for a perfectly matching application of further masks.

An alternative method involves the application of a photo-sensitive layer at first, which is then subjected to light exposure, and the pressed sheets or endless sheets are subjected to a rinsing process after the concluding development of the photo-sensitive layer, so only the parts of the photo-sensitive layer that constitute the mask for the subsequent etching process remain. The reproducibility of the masks produced in this way is very difficult and problematic, because the negative or positive that is used to illuminate the light-sensitive layer has to always be exactly arranged in the same position relative to the existing structure.

Several illumination and etching processes are therefore required to reproduce complicated, three-dimensional structures on the surface of the pressed sheet or the endless sheet, for instance. Even the smallest deviations will lead to substantial displacements of the structures due to the fact that extremely large format pressed sheets are involved. The reproducibility of the application of the mask is therefore especially associated with substantial difficulties in the case of the photographic process for obtaining a high level of replication precision. The difficulties can get worse when a three-dimensional structure has to be obtained via several illumination and etching processes that are required one after the other and there is a necessity of applying several masks one after the other for this and of carrying out an etching process between each instance of mask application. The production of pressed sheets or endless sheets is very complex and cost-intensive because of the precise positioning that is required and the number of corresponding masks that is required. The results that can be obtained are, moreover, very heavily dependent upon the processes that are used; extensive handling has to be taken into consideration due to the size of the pressed sheets or endless sheets.

As an alternative, the production of a mask with the press of a button via the application of wax instead of a screen printing process is known from the prior art. The wax that is applied is chemically resistant to the etching means that are used in connection with this, so etching can be done in the areas in which the surface is not covered by the wax. To this end, a spray head is used that sprays the wax onto the surface and that can be moved along an x and y axis, in order to replicate the required structure. The use of wax to apply a matrix has turned out to be disadvantageous, however, because the wax can only be removed from the surface again with difficulty and the required cleaning work is very cost-intensive. The costs that arise because of this and the dissolution of a wax matrix have lead to a situation in which other digitalized printing techniques are required. As an example, the application of a UV lacquer with the aid of a printing head onto the surface of the embossing tools to be processed, especially pressed sheets or endless sheets, is known.

The special advantage of the digitalized printing technique involves the fact that nearly identical masks can be applied over and over again to existing structures, and several etching processes to obtain a deep structure, for instance, can therefore be carried out one after the other in a perfectly matching way.

A process for applying coatings to surfaces in which a nozzle head is used and the individual nozzles are driven by control signals is known from DE 102 24 128 A1, for example. The nozzle head can either be used over the surface, or the surface to be treated is moved vis-a-vis the nozzle head. A UV lacquer that is cured via illumination with UV light after the application to the surface is preferably used in connection with this.

Regardless of the form in which the structuring of the surfaces of the pressed sheets or endless sheets was done, they will be subjected to several cleaning processes and can additionally be coated with a nickel, brass or copper layer that is subsequently refined with further metallic coatings. The surface gets a desired degree of gloss and a required surface hardness with the metallic coatings. The degree of gloss is responsible for the different shadings and color reflections that the pressed structure here receives after the pressing of the materials to be processed with the aid of the pressed sheets or endless sheets.

Furthermore, to improve the visual effect, there was a proposal to provide partial areas of the surface with different metallic coatings to vary the degree of gloss. Desired shading effects can be obtained with this measure.

DETAILED DESCRIPTION

The instant invention is based on the problem of presenting a further improved embossing tool and a method for creating same, in order to make diverse shading possibilities possible with the corresponding transfer to wooden material.

To solve the problem, the invention provides for the creation of further various degrees of gloss in several selected areas on a surface with an initial degree of gloss; the degrees of gloss are obtained via a metallic coating, mechanical follow-up treatment and/or chemical follow-up treatment and a protective layer (mask) is at least partially applied to the surface by means of a digital printing technique to establish the selected areas. Further advantageous process steps can be found in the sub-claims.

It is proposed that partial follow-up treatment be provided for individual areas of the surface via mechanical or chemical processes, in addition to the use of metallic coatings with different degrees of gloss, to create a multitude of degrees of gloss on an embossing tool and to keep the costs as low as possible. A combination of individual treatment processes is consequently involved here to give a specific degree of gloss to certain areas that are rendered by the wood grain of the surface, for example, on a structured surface of the embossing tool and to give other areas degrees of gloss differing from that; several different degrees of gloss could exist on a surface. On the one hand, these degrees of gloss are created via a metallic coating and, on the other hand, via mechanical or chemical treatments; a digitalized mask is applied between the individual treatment steps to only process or coat the areas that are supposed to get a differing degree of gloss.

It is possible in principle to use a metallic coating, mechanical follow-up treatment or chemical follow-up treatment to create a number of different degrees of gloss. They can either be applied individually or in combination in each case. A metallic coating, for instance via repeated chromium plating of the surface, especially suggests itself for embossing tools that are used in the production of floor coverings.

The possibility exists here after the end of the structuring measures to first apply chromium plating with a specific degree of gloss over the full surface, and a portion of this surface can then be provided with a differing degree of gloss after the application of a matrix via mechanical or chemical means or, if applicable, a further application of a metallic coating; these process steps can be repeated several times in individual areas.

A pure metallic coating of the embossing tools is unfavorable for the furniture industry. If an initial chromium plating with a specific degree of gloss is supplied and further processing steps are subsequently taken to create different degrees of gloss, this could lead to a situation in which clearly visible fingerprints are left behind when the finished composite panels are touched later on. This is considered to be particularly annoying by the end consumer, and it is regarded as a visual defect. Only making use of a chemical or mechanical follow-up treatment after the structuring in the initial process steps suggests itself here. But hard chromium plating is definitely supplied at the conclusion, however; only the degrees of gloss are set by the above-mentioned process steps. The surface is less sensitive during subsequent use with this procedure, and it permits the production of an embossing tool with high quality that meets the requirements for furniture production.

It is possible to do without the first chromium plating of the surface for this and to instead polish the surface to obtain a certain degree of gloss. The polishing can either be done in the form of mechanical polishing and/or electropolishing. Mechanical polishing especially suggests itself to obtain a low degree of gloss of the surface. Electropolishing can be used for a particularly fine surface and a particularly high degree of gloss.

Subsequent to that, a mask can be applied at least once, several times if necessary, to provide further partial areas of the surface structure with further degrees of gloss differing from the first degrees of gloss.

A metallic coating can be applied here in an individual case, but a mechanical or chemical treatment process can likewise be used. The special advantage results because of the combination of different treatment methods that the finest differences in the degree of gloss can be produced and, moreover, cost-effective production is also possible with multiple developments of the degrees of gloss.

A digital printing technique, which ensures a perfectly matching application of the protective layer even when it is repeated several times, is used to apply the protective layer (mask) in connection with this to obtain the different degrees of gloss. The protective layer can be applied in the following work steps in a form in which it is at least partially overlapping or not overlapping vis-a-vis the areas that have already been completed. It could be necessary, in dependence upon the existing structuring of the surface of the pressing tool, for the partial areas with different degrees of gloss to be arranged next to one another, but there is also a possibility that overlapping is desired for aesthetic reasons.

Different degrees of gloss can consequently be obtained because of the application of a second partial coating or a mechanical or chemical treatment to an existing first coating; the degrees of gloss of an embossing tool, especially of a pressed sheet or endless sheet, will deviate at least partially from one another in partial areas. It is possible with this measure to provide raised structures or, if applicable, lower-lying structures, with different degree of gloss to thereby especially highlight the structure. The visual impression is permanently improved with this measure, and this leads to a surface that can be realized with conforming patterns as a result of the perfectly matching printing templates and the perfectly matching matrix. Consequently, not only a different deep structure (haptics), but also different degrees of gloss can be achieved to highlight certain structural areas.

The difference in degrees of gloss can be provided as an option in connection with this, for instance the raised areas can have a higher degree of gloss than the deeper areas or vice versa.

Because of the repeated application of different degrees of gloss, whether via further coatings or via mechanical or chemical processes, the structured areas of the surface of the pressed sheet or the endless sheet can be highlighted even more clearly than was possible up to now. A significant improvement of a structuring that faithfully renders the details is consequently possible.

A lacquered, real wood surface can be recreated as an example; the raised areas will have a certain degree of matting, and the lower lying wood pore shows a shiny area caused by the light reflection. The wood pore structures that are required in connection with this are created with the aid of the perfectly matching matrix and the known etching technologies.

Because of the use of the digital printing technique, repeated instances of a perfectly matching arrangement and coverage of the respective structure are possible in connection with this, so a diversity of degrees of gloss can be obtained on an existing structured profile. As an example, a variation of the degree of gloss can be provided at an individual wood pore. A possibility likewise exists to give different degrees of gloss to individual wood pores that are either arranged adjacent another or that have a greater amount of spacing vis-a-vis one another. A possibility consequently exists to give different degrees of gloss to several neighboring wood pores in each case, in order to significantly improve the visual effect on the whole.

To create the surface structure, depth etching is done at first and then rounding etching as rule to bring out the design of the pore structure. Mechanical polishing can take place after that, before the surface is cleaned and degreased. The structured surface can additionally be activated before the application of the coatings for better adhesion of the metallic layers, especially the chromium layer, or other coatings can be applied that ensure better adhesion, for instance a nickel, brass or copper layer.

If a metallic coating is used, it is chromium plating as a rule; high gloss chromium plating or matte finish chromium plating could be involved. The use of other metallic coatings instead of the chromium plating is absolutely conceivable in connection with this.

If an initial coating was applied with the aid of chromium plating, however, it is absolutely necessary for the protective layer (mask) that is to be applied to be made of a material that is resistant to chromic acid to prevent the protective layer from being affected during the chromium plating or other chromium plating steps. If the process step to obtain a certain degree of gloss is carried out via polishing or sandblasting, the protective layer has to correspondingly be a material resistant to sandblasting or polishing to provide the surface under it with adequate protection against the follow-up treatment.

A burn-in of the protective layer can be done as a further intermediate step for better adhesion of the protective layer to the chromium plating that already exists; the protective layer is completely removed after the second treatment has been carried out. To obtain the respective degrees of gloss, a process step with matte etching, sandblasting or mechanical polishing can be provided in addition to metallic coating.

If a mechanical and/or chemical follow-up treatment is used to adjust the degree of gloss, there are two possibilities in principle, matting or polishing. The degree of gloss of the surface is reduced in general with matting. Etching and sandblasting processes are especially suitable here. The degree of gloss of the surface is increased with polishing. Mechanical polishing or electropolishing is especially suitable for this.

In a further design form of the invention, a process that is comprised of the following steps is envisaged to obtain several different degrees of gloss:

- Application of a mask to the surface by means of a digital printing technique,
- Chemical processing of the surface that has been supplied with a mask to obtain a surface structure,
- Polishing the chemically processed surface,
- Cleaning the surface,
- Matting the cleaned surface,
- Application of a further mask to the matted surface,
- Adjustment of a specific degree of gloss via polishing, preferably mechanical polishing or electropolishing,
- Hard chromium plating of the surface,
- wherein the steps after the matting up to the hard chromium plating of the surface are repeated at least once for partial areas, in order to obtain further differing degrees of gloss on the structured surface.

The above-mentioned procedure describes the possibility of carrying out chemical processing of the surface to obtain a surface structure after the application of a first mask to the existing surface of an embossing tool and of then carrying out renewed processing of the surface supplied with a second mask after application of the second, perfectly matching mask. After that, the surface can be polished, activated, cleaned and/or chromium plated before a further, third, perfectly matching mask is applied to the chromium-plated surface. The third mask covers the areas that are no longer supposed to be subjected to further treatment, whereas the exposed areas will subsequently get a different degree of gloss via another metallic coating or via mechanical or chemical follow-up treatment. The application of further masks and further follow-up treatments via a metallic coating or via mechanical or chemical follow-up treatment can be repeated an arbitrary number of times in connection with this.

Alternatively, the possibility exists to supplement the procedure with further steps that provide for the repeated application of a mask and processing of the surface to obtain the desired surface structure and degrees of gloss and, in fact,

- Application of a mask to the surface by means of a digital printing technique,
- Chemical processing of the surface that has been supplied with a mask to obtain a surface structure,
- Application of a further mask to the surface by means of a digital printing technique for fine structuring,
- Chemical processing of the surface that has been supplied with a mask to obtain fine structuring,
- Polishing the chemically processed surface,
- Cleaning the surface,
- Matting the cleaned surface,
- Application of a mask to the matted surface,
- Chromium plating of the surface,
- Renewed application of a further perfectly matching mask to the chromium-plated surface,
- Renewed metallic coating (6) or mechanical or chemical follow-up treatment of the chromium-plated surface supplied with the mask, wherein the steps after the matting of the surface are repeated at least once for partial areas, in order to obtain further differing degrees of gloss on the structured surface.

A further advantageous supplement to the procedure is activation after the polishing of the surface in accordance with the following process steps:

Application of a mask to the surface by means of a digital printing technique,

Chemical processing of the surface that has been supplied with a mask to obtain a surface structure, Polishing the chemically processed surface, Activation of the polished surface, Cleaning the activated surface, Matting the cleaned surface, Application of a mask to the matted surface, Adjustment of a specific degree of gloss via polishing, preferably mechanical polishing or electropolishing, Hard chromium plating of the surface, wherein the steps after the matting up to the hard chromium plating of the surface are repeated at least once for partial areas, in order to obtain further differing degrees of gloss on the structured surface.

In another advantageous design form, fine structuring is combined with the activation and, in fact, as follows:

Application of a mask to the surface by means of a digital printing technique,

Chemical processing of the surface that has been supplied with a mask to obtain a surface structure, Application of a mask to the surface by means of a digital printing technique for fine structuring, Chemical processing of the surface that has been supplied with a mask to obtain fine structuring, Polishing the chemically processed surface, Activation of the polished surface, Cleaning the activated surface, Application of a mask to the cleaned surface, Matting the cleaned surface, Application of a mask to the matted surface, Adjustment of a specific degree of gloss via polishing, preferably mechanical polishing or electropolishing, Hard chromium plating of the surface, wherein the steps after the cleaning up to the hard chromium plating of the surface are repeated at least once for partial areas, in order to obtain further differing degrees of gloss on the structured surface.

If chromium plating of the surface is done as a first step to adjust the degree of gloss, it can be carried out in the following way:

Application of a mask to the surface by means of a digital printing technique,

Chemical processing of the surface that has been supplied with a mask to obtain a surface structure, Polishing the chemically processed surface, Cleaning the surface, Chromium plating of the surface, Renewed application of a further perfectly matching mask to the chromium-plated surface, Renewed metallic coating or mechanical or chemical follow-up treatment of the chromium-plated surface supplied with the mask, Hard chromium plating of the surface, wherein the steps after the first instance of chromium plating up to the hard chromium plating of the surface are repeated at least once for partial areas, in order to obtain further differing degrees of gloss on the structured surface.

A combination of initial chromium plating and a further instance of chromium plating according to the following steps is especially advantageous:

Application of a mask to the surface by means of a digital printing technique,

Chemical processing of the surface that has been supplied with a mask to obtain a surface structure, Application of a further mask to the surface by means of a digital printing technique for fine structuring, Chemical processing of the surface that has been supplied with a mask to obtain the fine structuring, Polishing the chemically processed surface, Cleaning the surface, Chromium plating of the surface, Renewed application of a further perfectly matching mask to the chromium-plated surface, Renewed metallic coating or mechanical or chemical follow-up treatment of the chromium-plated surface supplied with the mask, Hard chromium plating of the surface, wherein the steps after the first instance of chromium plating up to the hard chromium plating of the surface are repeated at least once for partial areas, in order to obtain further differing degrees of gloss on the structured surface.

Furthermore, the surface can be activated before the application of the first chromium layer in accordance with the following sequence of steps:

Application of a mask to the surface by means of a digital printing technique,

Chemical processing of the surface that has been supplied with a mask to obtain a surface structure, Application of a further mask to the surface by means of a digital printing technique for fine structuring, Polishing the chemically processed surface, Activation of the polished surface, Cleaning the activated surface, Chromium plating of the surface, Renewed application of a further perfectly matching mask to the chromium-plated surface, Renewed metallic coating or mechanical or chemical follow-up treatment of the chromium-plated surface supplied with the mask, Hard chromium plating of the surface, wherein the steps after the first instance of chromium plating up to the hard chromium plating of the surface are repeated at least once for partial areas, in order to obtain further differing degrees of gloss on the structured surface.

In an especially advantageous design form, the degree of gloss can first be adjusted with matting an polishing and then with a surface treatment. The following process steps are required for this, as an example:

Application of a mask to the surface by means of a digital printing technique,

Chemical processing of the surface that has been supplied with a mask to obtain a surface structure, Polishing the chemically processed surface, Cleaning the surface, Matting the cleaned surface, Application of a further mask to the matted surface, Adjustment of a specific degree of gloss via polishing, preferably mechanical polishing or electropolishing, Renewed application of a further perfectly matching mask to the surface, Metallic coating or mechanical or chemical follow-up treatment of the surface supplied with the mask, Hard chromium plating of the surface, wherein the steps after the polishing up to the hard chromium plating of the surface are repeated at least once for partial areas, in order to obtain further differing degrees of gloss on the structured surface.

An activation of the surface can likewise be especially advantageous in connection with this and, in fact:

Application of a mask to the surface by means of a digital printing technique,

Chemical processing of the surface that has been supplied with a mask to obtain a surface structure, Polishing the chemically processed surface, Activation of the polished surface, Cleaning the activated surface, Matting the cleaned surface, Application of a further mask to the matted surface, Adjustment of a specific degree of gloss via polishing, preferably mechanical polishing or electropolishing, Renewed application of a further perfectly matching mask to the surface, Metallic coating or mechanical or chemical follow-up treatment of the surface supplied with the mask, Hard chromium plating of the surface, wherein the steps after the polishing up to the hard chromium plating of the surface are repeated at least once for partial areas, in order to obtain further differing degrees of gloss on the structured surface.

In a further advantageous design form, fine structuring, activation, matting and polishing can be combined as follows:

Application of a mask to the surface by means of a digital printing technique,

Chemical processing of the surface that has been supplied with a mask to obtain a surface structure, Application of a further mask to the surface by means of a digital printing technique for fine structuring, Chemical processing of the surface that has been supplied with a mask to obtain the fine structuring, Polishing the chemically processed surface, Activation of the polished surface, Cleaning the activated surface, Matting the cleaned surface, Application of a mask to the matted surface, Adjustment of a specific degree of gloss via polishing, preferably mechanical polishing or electropolishing, Renewed application of a further perfectly matching mask to the surface, Metallic coating or mechanical or chemical follow-up treatment of the chromium-plated surface supplied with the mask, Hard chromium plating of the surface, wherein the steps after the polishing up to the hard chromium plating of the surface are repeated at least once for partial areas, in order to obtain further differing degrees of gloss on the structured surface.

The above-mentioned processes distinguish themselves by the fact that coverage conforming to the structure exists and no deviation from the desired structure results over the entire surface of the pressed sheets or endless sheets. The number of masks is determined by the number of required processing steps in connection with this; the structuring of the surface is at the center of attention so that a desired adjustment of the degrees of gloss can then be done. The frequency of masks to be applied and processing operations is essentially dependent upon the surface structuring in connection with this, for instance whether a realistic reproduction of a wood pore or a stone surface is involved or if graphic, artificial structures are to be reproduced with a faithful rendering of the details.

The application of the process in accordance with the invention leads to an embossing tool with a structured surface that completely extends over the entire surface of the embossing tool and that has different degrees of gloss with the aid of metallic coatings and follow-up treatment processes. Material coating with chromium is frequently done to this end, because it is especially hard and the most suited to the pressing operations that are to be carried out. The possibility of pressing other materials that do not have an especially high degree of hardness and that have a surface designed to be elastic and soft exists without further ado, however, so other metallic coatings are also possibilities for achieving different degrees of gloss.

The special advantage of the process in accordance with the invention and of the embossing tool presented here involves the creation of identical structures as they were previously known in nature with different degrees of gloss that have an especially pleasant visual effect and haptics so that the impression arises that naturally grown wood is involved, for instance. Because of the different degrees of gloss, certain areas, for instance raised areas or even lower lying areas, can additionally be provided with several differing degrees of gloss in connection with this, so the structure will stand out in a very prominent way and create a visual effect leading to a material surface that can hardly be distinguished from natural wood, for instance. Alternatively, the possibility exists to correspondingly replicate other realistic surfaces.

BRIEF DESCRIPTION OF THE DRAWINGS

The invention will be explained once again below with the aid of the figures.

DETAILED DESCRIPTION OF THE PREFERRED EMBODIMENT

Figure 1:
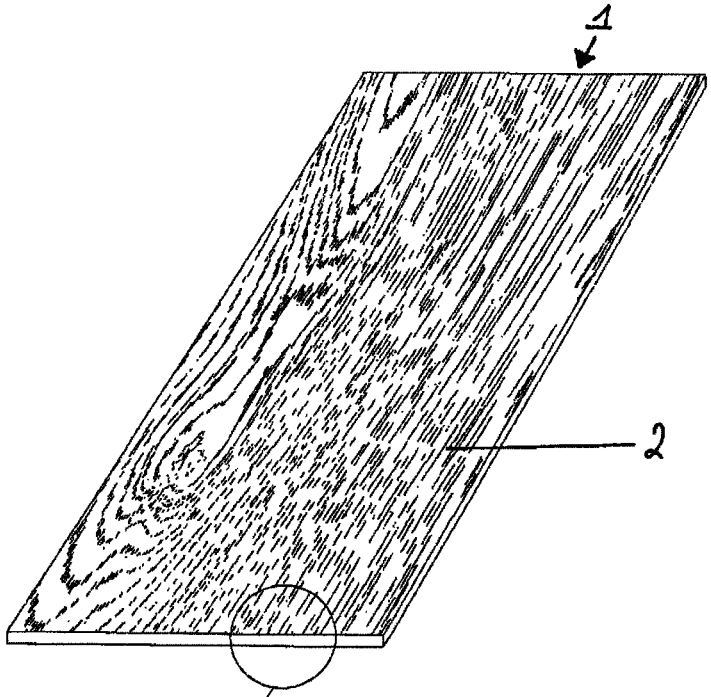
FIG. 1 shows a pressed sheet in accordance with the invention in a perspective view and FIG. 2 shows the existing structure on the surface of the pressed sheet with different degrees of gloss in an enlarged side view.

FIG. 1 shows, in a perspective view, a pressed sheet 1 in accordance with the invention that is designed to be flat in the example that is shown. This embossing tool can also be designed to be curved in the case of an endless sheet, however. The pressed sheet 1 shows a grain 2 that is replicated in the form of a wood structure. It is conceivable, however, that other kinds of grain or other surface characteristics of this type can be created with the process in accordance with the invention and the etching process that is required for that.

Figure 2:
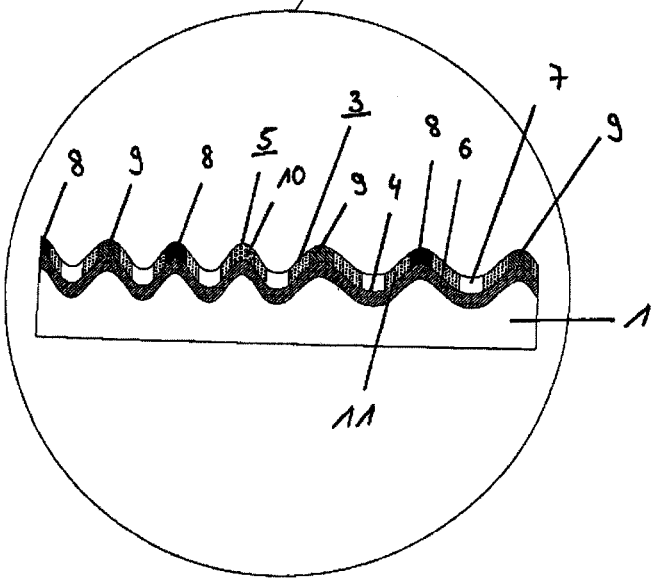

FIG. 2 shows, in an enlarged side view, a portion of the front edge area of the pressed sheet 1 and the structure 3 found on it, which has a surface resembling mountains with valleys 4 and peaks 5. The surface is created by one or more etching processes in connection with this, after the previous application of a matrix in a standard process or with a digitalized printing technique; the areas that are not supposed to be subjected to the etching processes are covered by the mask. Fine surface structures and deep structures that are additionally rounded off via mechanical processes or etching processes if necessary after that, as examples, can be created with the aid of the etching processes. After the surface is etched, the surface structure is finished off with further chemical processing, polishing and, if applicable, activation of the polished surface, so cleaning is subsequently done before an initial metallic coating 6 is applied with a certain degree of gloss.

The metallic coating 6 has a certain degree of gloss that is in line with the customer's requests. A mask is subsequently applied once again to this first metallic coating 6 that covers the areas that are not supposed to be subjected to any further treatment.

The exposed areas can, on the other hand, be provided with a different degree of gloss via further processing techniques and, in fact, via matte etching, sandblasting or mechanical polishing or another application of a metallic coating, for instance.

The process in accordance with the invention provides here for a mask to be applied for certain partial areas in each case and for the exposed areas to be subjected to a further treatment process. This process can be repeated several times after the applied mask is removed, so the structure 3 of the pressed sheet 1 will get differing degrees of gloss in selected areas.

Various degrees of gloss arose on the first metallic coating 6 via the application of different masks and subsequent treatment processes in the example that was shown. There was no treatment in the area of the valleys 4, for instance, so the areas 7 indicated in white have the degree of gloss of the first metallic coating 6, whereas, in contrast, the tips of the peaks 5 have degrees of gloss differing from that. These differing degrees of gloss are indicated by the areas 8 completely colored in and by the hatched areas 9 and 10. A degree of gloss deviating from that arose via a subsequent process step by applying a corresponding mask in the transition areas of the valleys 4 and peaks 5. These areas 11 are presented with stippling.

In deviation from the example, however, the freedom exists to provide all of the peaks 5 with a uniform degree of gloss or to give the transition areas degrees of gloss that differ from one another if that is desired. This invention basically makes it possible to vary the arrangement of the individual degrees of gloss in any way desired via the application of a digitalized mask and the process steps envisioned for that to create a degree of gloss. If a wood structure is being replicated on the pressed sheet 1 with the etching process that is applied, the possibility exists, as an example, to provide the raised areas 5 with a matte degree of gloss and to provide the lower lying areas that constitute the wood pore with a higher degree of gloss. Because of the possibility of applying several masks and obtaining a certain degree of gloss in a subsequent process step, raised areas that are next to one another can be provided with different degrees of gloss, for instance.

The possibility likewise exists of providing the flanks of individual raised areas with a different degree of gloss to clearly bring out the visual effect of the wood pores. The wood-pore structures that perfectly match the wood decor print are especially highlighted with this measure, and they give the products manufactured with the pressed sheets the appearance of having real wood characteristics that come very close to the natural product.

LIST OF REFERENCE NUMERALS

1 Pressed sheet
2 Grain
3 Structure
4 Valley
5 Peak
6 Coating
7 Area
8 Area
9 Area
10 Area
11 Area

The invention claimed is:

1. A method for processing a surface of an embossing tool, in which at least one surface is subjected to a first treatment step in the form of a metallic coating, a mechanical gloss-changing treatment or a chemical treatment over the entire area to achieve a degree of gloss and there is at least one further step in selected areas (7, 8, 9, 10, 11) to achieve at least one further different degree of gloss, characterized in that the at least one further different degree of gloss is obtained in several selected areas (7, 8, 9, 10, 11) on the surface with the first degree of gloss, wherein the at least one further degree of gloss is obtained via a metallic coating, mechanical follow-up treatment or chemical follow-up treatment, wherein a protective layer is at least partially applied to the surface by means of a digital printing technique to establish the selected areas (7, 8, 9, 10, 11), and wherein the protective layer is applied in a partially overlapping form with respect to the areas that have already been completed.

2. A method according to claim 1, characterized in that the further degrees of gloss of the surface have at least partially a spacing between them.

3. A method according to claim 1, characterized in that a material that is resistant to etching, sandblasting or polishing is used for the protective layer.

4. A method according to claim 1, characterized in that a chromium coating is applied to the surface or the further degrees of gloss of the surface are obtained by etching or sandblasting.

5. A method according to claim 1, characterized in that the further degrees of gloss of the surface are obtained by mechanical polishing or electropolishing.

6. A method according to claim 1, characterized in that the surface is activated before the first treatment step or a chromium plating is applied to the surface after the production of the last further degree of gloss.

7. A method for processing a surface of an embossing tool, in which at least one surface is subjected to a first treatment step in the form of a metallic coating or a chemical treatment over the entire area to achieve a degree of gloss and there is at least one further step in selected areas to achieve at least one further different degree of gloss, characterized in that the at least one further different degree of gloss is obtained in several selected areas on the surface with the first degree of gloss, wherein the at least one further degree of gloss is obtained via a metallic coating, mechanical follow-up treatment or chemical follow-up treatment and wherein a protective layer is applied in a partially overlapping form with respect to the areas that have already been completed.

* * * * *